US005964597A

United States Patent [19]

Hirata et al.

[11] Patent Number: 5,964,597

[45] Date of Patent: Oct. 12, 1999

[54] PC CARD ASSEMBLY AND METHOD OF ASSEMBLING THE SAME

[75] Inventors: Hideyuki Hirata, Yokohama; Toshihisa Hirata, Yamato, both of Japan

[73] Assignee: Molex Incorporated, Lisle, Ill.

[21] Appl. No.: 08/895,144

[22] Filed: Jul. 16, 1997

[30] Foreign Application Priority Data

Jul. 26, 1996 [JP] Japan ..... 8-215531

[51] Int. Cl.[6] ..... H01R 13/648

[52] U.S. Cl. ..... 439/108; 439/607

[58] Field of Search ..... 439/541.5, 79, 439/607, 609, 108, 101

[56] References Cited

U.S. PATENT DOCUMENTS

| | | | |
|---|---|---|---|
| 5,288,247 | 2/1994 | Kaufman | 439/607 |
| 5,299,089 | 3/1994 | Lwee | 439/541.5 |
| 5,305,182 | 4/1994 | Chen | 439/541.5 |
| 5,316,488 | 5/1994 | Gardner et al. | 439/541.5 |
| 5,399,105 | 3/1995 | Kaufman et al. | 439/609 |
| 5,470,259 | 11/1995 | Kaufman et al. | 439/607 |
| 5,478,260 | 12/1995 | Kaufman et al. | 439/609 |

FOREIGN PATENT DOCUMENTS

WO 94/22182 9/1994 European Pat. Off. .

OTHER PUBLICATIONS

PC Card Standard Document 0295–03–1500 (Figs. 35 and 36).

*Primary Examiner*—Gary F. Paumen
*Attorney, Agent, or Firm*—Stacey E. Caldwell

[57] ABSTRACT

Disclosed is an improved method of forming a two-storied type of PC card connector assembly. It comprises the steps of: attaching one card connector to one side of a printed circuit board; soldering the soldering tails of the signal terminals to the signal circuit pattern formed on the one side of the printed circuit board, and the soldering tails of the ground terminals to the through-holes made in the printed circuit board; attaching the other card connector to the other side of the printed circuit board (no ground terminal piece attached thereto); soldering the soldering tails of the signal terminals to the circuit pattern formed on the other side of the printed circuit board; press-fitting a separate ground terminal piece in the other card connector; and soldering the soldering tails of the ground terminal piece to the ground circuit pattern formed on the other side of the printed circuit board.

1 Claim, 3 Drawing Sheets

PC CARD ASSEMBLY AND METHOD OF ASSEMBLING THE SAME

FIELD OF THE INVENTION

The present invention relates to a PC card connector assembly and a method of assembling a PC card connector assembly comprising a printed circuit board and a PC card connector on each side of the printed circuit board, each PC card connector having signal terminals and ground terminals.

DESCRIPTION OF THE PRIOR ART

The signal terminals and ground terminals of known PC card connectors typically have solder tails formed in a right angle configuration and positioned at the rear end of the PC card connector such that the ends of the solder tails are directed to and in contact with circuit traces on the underlying printed circuit board. These solder tails are often fixed to the circuit board by dip-soldering whereby they are inserted in through-holes made in the circuit board and then soldered.

In applications where two PC card connectors are used in a stacked or "dual port" configuration, the circuit board uses a relatively large area allotted to the layout of the through-holes for accommodating each row of solder tails (often two rows of tails for the signal terminals and one for the ground terminals) for each connector. One attempt to solve the problem of occupying such a large area with through-holes is to place one PC card connector on one side of the circuit board and a second PC card connector on the other side of the circuit board. In assembling such an arrangement, however, there are some tradeoffs due to the layout that must be considered. Specifically, since the solder tails of the signal and ground terminals are arranged in at least two different rows, alignment of the solder tails with respect to the circuit pattern formed on the circuit board is difficult to inspect and correct. Particularly, visually inspecting and correcting the alignment of the solder tails positioned toward the inside of the assembly is more difficult than inspecting and correcting the solder tails positioned toward the outside of the assembly.

SUMMARY OF THE INVENTION

One object of the present invention is to provide a dual port PC connector assembly occupying a relatively small area on the printed circuit board, while allowing and facilitating visual inspection and correction of the alignment of the solder tails of the signal and ground terminals.

To attain this and other objects, a PC card connector assembly is improved according to the present invention in that it comprises: a first PC card connector for mounting to a printed circuit board including signal terminals having surface mount solder tails adapted to be surface mounted to a first side of the circuit board; a first ground piece mounted on the first PC card connector and including through-hole solder tails adapted to be mounted within holes in the circuit board; a second PC card connector for mounting to the circuit board including signal terminals having surface mount solder tails adapted to be surface mounted to an opposite side of the circuit board; and a second ground piece for mounting on the second PC card connector and including surface mount solder tails adapted to be mounted to the surface of the opposite side of the circuit board.

Further according to the invention, a method of forming a PC card connector assembly is disclosed, the PC card connector assembly including a printed circuit board and first and second PC card connectors fixed to opposite sides of the circuit board, each PC card connector having signal terminals and ground terminals, the method of forming the assembly comprising the steps of: attaching the first PC card connector to one side of the printed circuit board, the solder tails of the signal terminals of the first PC card connector being of surface mount type, and the solder tails of the ground piece of the first PC card connector being of dip-soldering type; soldering the solder tails of the signal terminals of the first PC card connector to the signal circuit pattern formed on the surface of the one side of the circuit board; soldering the solder tails of the ground piece of the first PC card connector within the through-holes of a ground circuit of the printed circuit board; attaching the second PC card connector to an opposite side of the circuit board, the solder tails of the signal terminals of the second PC card connector being of surface mount type; soldering the solder tails of the signal terminals of the second PC card connector to the signal circuit pattern formed on the surface of the other side of the circuit board; assembling a ground terminal piece onto the second PC card connector, the solder tails of the ground terminal piece being of surface mount type; and soldering the solder tails of the ground terminal piece of the second PC card connector to a ground circuit pattern formed on the surface of the opposite side of the circuit board.

Soldering the solder tails of the signal terminals and soldering the solder tails of the ground piece of the first PC card connector on the first side of the circuit board can be effected simultaneously by reflow soldering, for example.

The surface mount solder tails of the signal and ground terminals of the second PC card connector are soldered to the circuit pattern formed on the opposite side of the circuit board, thus reducing the total area occupied on the circuit board by the dual port PC card assembly. In additional, visual inspection of the solder tails of the signal terminals of the first PC connector can be performed without obstruction by the solder tails of the ground terminals. The solder tails of the ground terminals can also be inspected from the opposite side without obstruction. Visual inspection of the solder tails of the signal terminals of the second PC connector can be performed without obstruction by the solder tails of the ground terminals, which are soldered subsequent to the signal terminals. The solder tails of the ground terminals can also be inspected easily, i.e., without visual obstruction, after it is assembled on the second PC card connector.

Other objects and advantages of the present invention will be understood from the following description of a preferred embodiment of the present invention, which is illustrated in the accompanying drawings.

DETAILED DESCRIPTION OF THE PREFERRED EMBODIMENT

Figure 1:
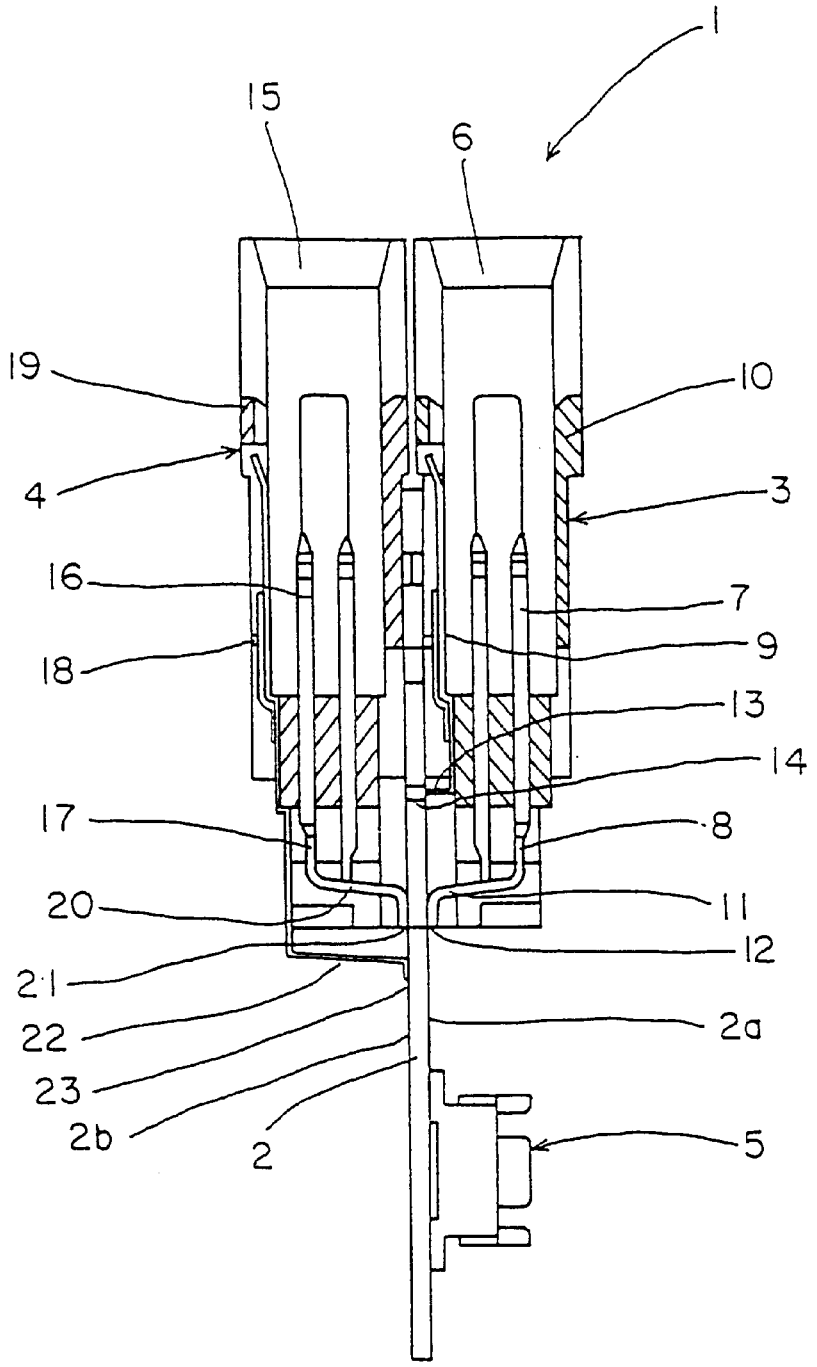
FIG. 1 is an enlarged longitudinal section view of a PC card connector assembly, which is made according to the present invention.
Figure 2:
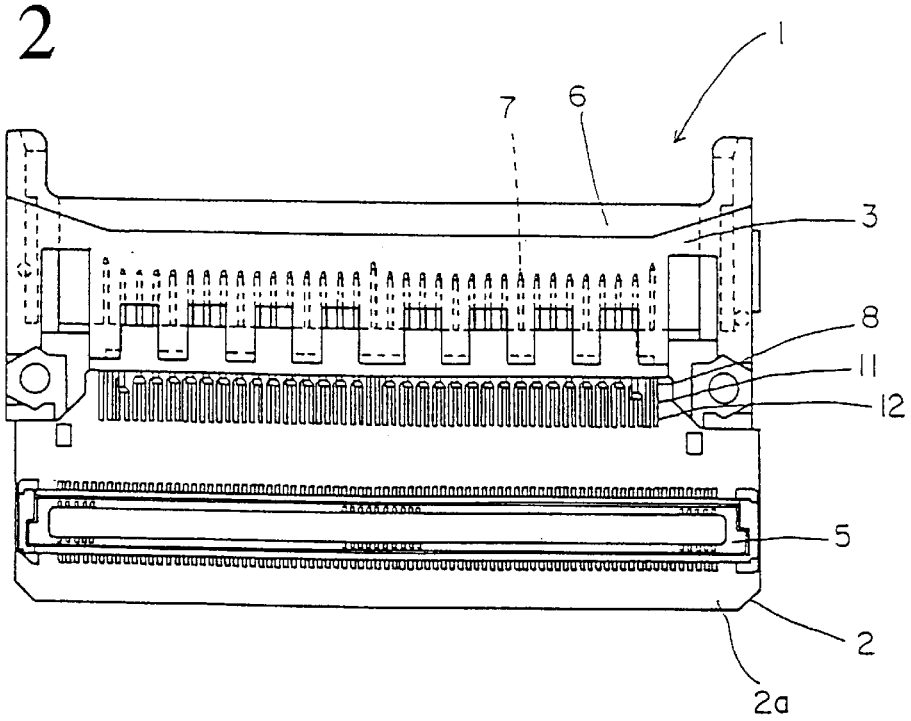
FIG. 2 is a plan view of the PC card connector assembly.
Figure 3:
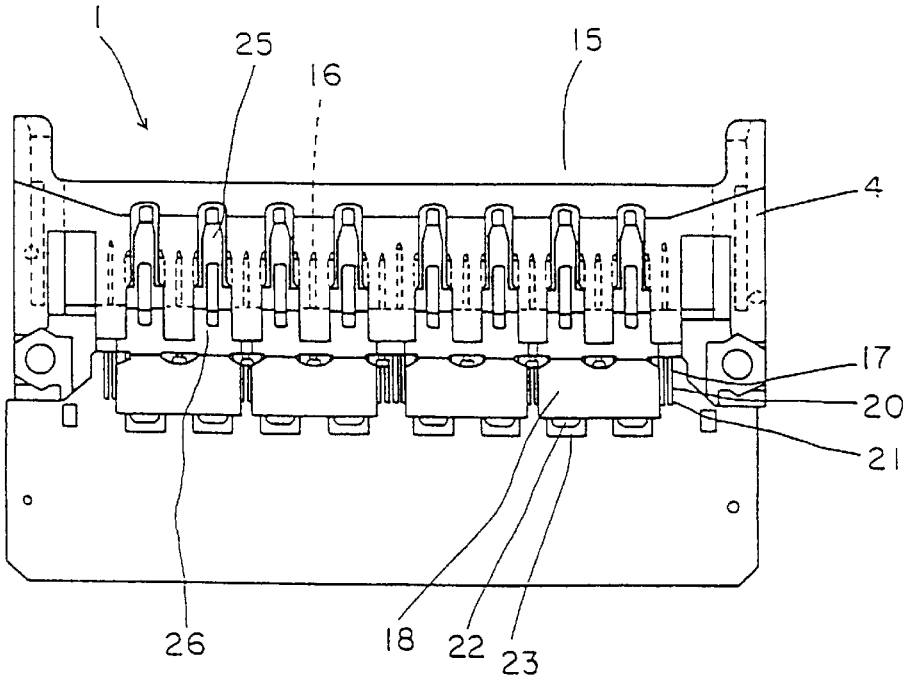
FIG. 3 is a rear view of the PC card connector assembly.
Figure 4:
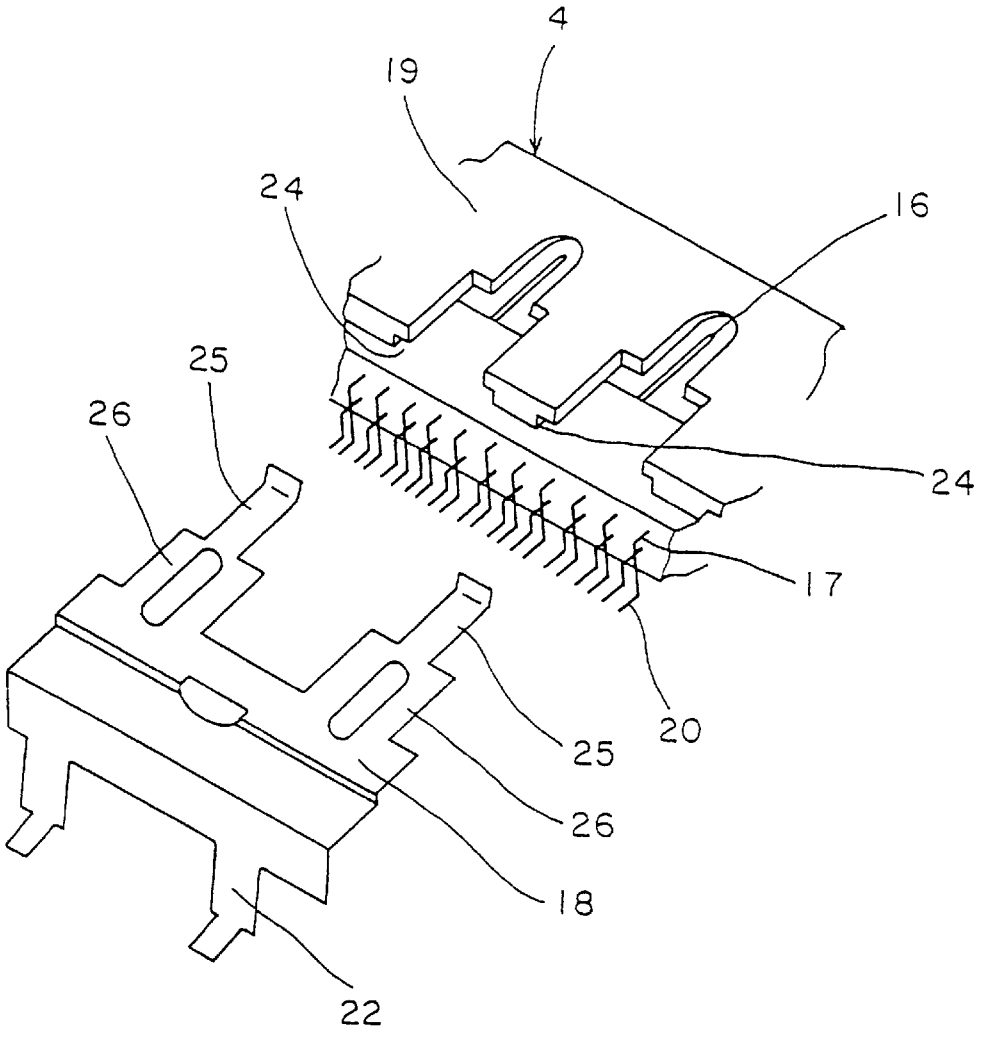
FIG. 4 is a perspective view of a ground terminal piece to be assembled to the second PC connector fixed to the opposite side of the printed circuit board.

Referring to the drawings and first to FIGS. 1 through 3, a PC card connector assembly 1 comprises a printed circuit board 2 and first and second PC card connectors 3 and 4 fixed to front and rear sides 2*a* and 2*b* of printed circuit board 2, respectively. Printed circuit board 2 has a receptacle connector 5 for connecting the printed circuit board to a group of wires or other electrical boards via an associated plug connector (not shown).

PC card connector 3 mounted on the front side of the printed circuit board includes right angle-configured signal terminals 8 which have two rows of contacts 7 located in a card slot 6 of a connector housing 10 of PC card connector 3. Surface mount solder tails 11 of signal terminals 8 are adapted to be surface mounted to a conductive pattern 12 of a signal circuit (not shown) formed on the surface of front side 2*a* of printed circuit board 2. The connector housing 10 has a ground terminal piece 9 mounted thereto. Right angle-configured solder tails 13 of ground piece 9 are adapted to be dip-soldered within through-holes 14 of a ground circuit (not shown) on front side 2*a* of circuit board 2.

PC card connector 4 mounted on rear side 2*b* of printed circuit board 2 includes right angle-configured signal terminals 17 which have two rows of contacts 16 located in a card slot 15 of a connector housing 19. Surface mount solder tails 20 of signal terminals 17 are adapted to be surface-mounted to a conductive pattern 21 of a signal circuit formed on the surface of rear side 2*b* of circuit board 2. Connector housing 19 has a ground terminal piece 18 mounted thereon. Ground piece 18 comprises a lateral base, mount projections 26 integrally connected to one side of the lateral base, each projection having a contact 25 integrally connected thereto, and right angle-configured solder tails 22 integrally connected to the other side of the lateral base. Connector housing 19 has insertion slots with notched edges 24 in opposite sides of the slots, thus permitting the insertion of mount projections 26 of ground piece 18 into connector housing 19. Surface mount solder tails 22 of ground terminal piece 18 are adapted to be surface mounted to a conductive pattern 23 of a ground circuit (not shown) also formed on the surface of rear side 2*b* of circuit board 2.

Now, the method of assembling the PC card connector assembly will be described. The method comprises the steps of: placing the first PC card connector 3 on a first side 2*a* of the printed circuit board 2, inserting the through-hole solder tails 13 of ground piece 9 in the through-holes 14 of the circuit board, and placing the surface mount solder tails 11 of the signal terminals 8 on the conductive pattern 12 formed on the surface of first side 2*a* of the circuit board. The soldering of both sets of solder tails can be effected simultaneously, for example by reflow soldering. Prior to soldering, the location and alignment of the surface mount solder tails 11 relative to the conductive pattern 12 is visually inspected so that misalignments and other problems with the solder tails can be detected and corrected before soldering. No visual obstructions interfere with the inspection of the solder tails 11 since they are located on the outside of the assembly, thereby facilitating visual inspection thereof. Also, visual inspection of the through-hole solder tails 13 of ground piece 9 can be performed from the opposite side 2*b* of circuit board 2, i.e. looking for the presence of a tail within or protruding from the through-hole itself, since no connector has been placed over the tails to obstruct the inspection.

After fixing the first PC connector 3 to the first side 2*a* of circuit board 2, a second PC connector 4 is placed on the second or opposite side 2*b* of the circuit board, and the required solder connections are made. The second PC connector 4 is designed to permit the subsequent assembly of separate ground piece 18 to the connector housing 19.

After placing the second PC connector 4 on the second side of the circuit board (prior to assembling the separate ground piece), the alignment of surface mount solder tails 20 of signal terminals 17 relative to a conductive pattern 21 formed on the surface of the second side of the circuit board is visually inspected, and misalignments and other problems with the signal terminal solder tails 20 can be detected and corrected. The inspection and correction of misalignments of the solder tails can be performed without difficulty because there are no obstacles that interfere. After checking the signal terminal solder tail alignment, the solder tails are soldered to the conductive pattern 21, for example by reflow soldering. After soldering, visual inspection of the solder joint can also be made.

After assembling the second connector to the second side of the circuit board, the ground piece 18 is press-fit into the connector housing 19 of the second PC card connector so that solder tails 22 of the ground piece are in contact with the corresponding portions of a conductive pattern 23 of a ground circuit formed on the second side of the circuit board. Visual inspection of the relative positioning between solder tails 22 and the corresponding portions of conductive pattern 23 of the ground circuit can be made easily because the interface is visually free of any obstacles.

After visual inspection is performed on the positioning of the tails, the tails are soldered to the ground circuit. After soldering, the solder joints can be inspected as well.

The PC card connector assembly according to the present invention results.

It is understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A method of assembling a PC card connector assembly (1) including a printed circuit board (2) and first and second PC card connectors (3,4) fixed to opposite sides (2*a*, 2*b*) of the printed circuit board, the first PC card connector (3) including signal terminals (8) having surface mount type solder tails (11) and a first ground piece (9) having through-hole type solder tails (13), the second PC card connector (4) including signal terminals (17) having surface mount type solder tails (20) and a separate second ground piece (18) having surface mount type solder tails, the method comprising the steps of:

placing the first PC card connector (3) on the first side (2*a*) of the printed circuit board;

simultaneously soldering the solder tails (11) of the signal terminals (8) of the first PC card connector to a signal circuit pattern (12) formed on a surface of the first side of the printed circuit board and the solder tails (13) of the first ground piece (9) within the through-holes (14) of a ground circuit of the printed circuit board;

placing the second PC card connector (4) on the second side (2*b*) of the printed circuit board;

soldering the solder tails (20) of the signal terminals (17) of the second PC card connector to a signal circuit pattern (21) formed on a surface of the second side (2*b*) of the printed circuit board;

subsequently mounting the second ground piece (18) onto the second PC card connector (4); and soldering the solder tails (22) of the second ground piece (18) to a ground circuit pattern (23) formed on the surface of the second side of the circuit board.

* * * * *